United States Patent [19]

Panicci

[11] 4,403,613

[45] Sep. 13, 1983

[54] PACIFIER

[75] Inventor: Richard L. Panicci, Hanover, Mass.

[73] Assignee: Kiddie Products, Inc., Avon, Mass.

[21] Appl. No.: 241,589

[22] Filed: Mar. 9, 1981

[51] Int. Cl.[3] ..... A61J 17/00

[52] U.S. Cl. ..... 128/360; 128/359

[58] Field of Search ..... 128/359, 360, 252; 215/11.3

[56] References Cited

U.S. PATENT DOCUMENTS

| | | | |
|---|---|---|---|
| D. 231,033 | 3/1974 | Sofro | D83/8 C |
| D. 237,222 | 10/1975 | Moore | D83/8 C |
| D. 237,554 | 11/1975 | Hurst | D83/8 C |
| D. 245,790 | 9/1977 | Meeker et al. | D24/45 |
| D. 248,317 | 6/1978 | Meeker et al. | D24/46 |
| D. 249,161 | 8/1978 | Röhrig | 128/360 |
| 2,366,214 | 1/1945 | Ramaker | 128/252 |
| 3,424,157 | 1/1969 | Paolo | 128/360 |
| 3,662,756 | 5/1972 | Hakim | 128/360 |
| 3,669,112 | 6/1972 | Mager et al. | 128/360 |
| 3,924,621 | 12/1975 | Cassimally | 128/360 |
| 4,078,570 | 3/1978 | Frodrich et al. | 128/359 |
| 4,132,232 | 1/1979 | Lerner | 128/360 |

FOREIGN PATENT DOCUMENTS

| | | | |
|---|---|---|---|
| 530266 | 7/1954 | Belgium | 128/360 |
| 2037836 | 1/1973 | Fed. Rep. of Germany | 128/360 |
| 64814 | 6/1949 | Netherlands | 128/359 |
| 899 | of 1892 | United Kingdom | 128/360 |

*Primary Examiner*—Kyle L. Howell
*Assistant Examiner*—C. W. Shedd

[57] ABSTRACT

A one-piece pacifier for an infant comprising a shield having a nipple extending from one side and a handle extending from the other, the lower portion and sides of the shield being curved away from the nipple to present a larger area where the shield might rest against an infant's chin and face thereby reducing irritation, and the handle being angled downwardly towards the curved portion of the shield so as to deflect toward the shield rather than push the nipple towards the infant's throat when force, such as when the infant presses its face against a mattress, is applied to the handle side of the pacifier.

3 Claims, 3 Drawing Figures

PACIFIER

FIELD OF THE INVENTION

This invention relates to infant's pacifiers.

BACKGROUND OF THE INVENTION

Infant pacifiers are well known and generally comprise a shield having a nipple on one side and a handle on the other. The shield of the prior art pacifiers is usually flat or in the case of some orthodontic-type devices curved toward the nipple. Also, the handle of the prior art pacifiers extends perpendicularly from the shield, and the shield, nipple and handle may be made of separate parts.

These prior art pacifiers have several drawbacks. First, a small portion of the shield, of both the flat-shield and the orthodontic devices, presses against infant's chin causing irritation. Also, if the infant should roll over or otherwise move so that the handle pushes against something, e.g. the crib mattress, the prior art handle will transmit the force to the shield and push the nipple towards the infant's throat. Finally, despite various locking arrangements for the individual parts, it may be possible for the parts to separate, and the individual parts might be small enough to be swallowed.

SUMMARY OF THE INVENTION

I have discovered an improved pacifier which minimizes infants' chin irritation and the tendency of the nipple to be thrust toward the infant's throat due to pressure on its handle. In addition, the pacifier is molded as a single unit.

In the preferred embodiment, a hollow orthodontic nipple extends axially from a shield, the lower portion of the shield, which comprises the shield, its peripheral edge and the adjacent lower sides, and which all would be adjacent to the infant's chin and lower face when in use, is curved away from the nipple thereby separating it from the face and increasing the area of the shield which might rest against it; and a handle, consisting of a solid loop integral with the shield and nipple is angled downwards towards the curved portion of the shield, thereby allowing the handle to fold flat against the adjacent portion of the shield should force in the direction of the shield be applied to the handle.

DESCRIPTION OF THE PREFERRED EMBODIMENT

We turn now to the structure and operation of a preferred embodiment of my invention, after first briefly describing the drawings.

STRUCTURE

Figure 1:
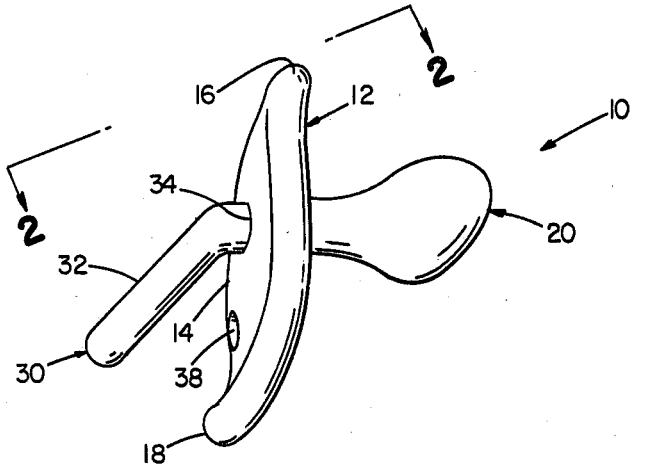
FIG. 1 is a side view of the pacifier of this invention.

Referring to FIG. 1, an infant's pacifier of this invention is shown at 10. Pacifier 10 generally comprises a shield 12, a nipple 20 and a handle 30, all molded of a single piece of resilient material, e.g., plasticized vinyl.

Shield 12 comprises a concave central section 14 surrounded by a peripheral edge 16. Nipple 20, which is formed in an orthodontic shape, extends perpendicularly from the approximate center of the concave central section 14. Shield 12 and edge 16 are curved inwardly in the direction of the nipple 20 except for a lower portion 18. Lower portion 18 which includes the lower sides of shield 12 curves away from nipple 20, from a point about midway between the nipple and the bottom edge, as shown in FIGS. 1 and 3.

Figure 2:
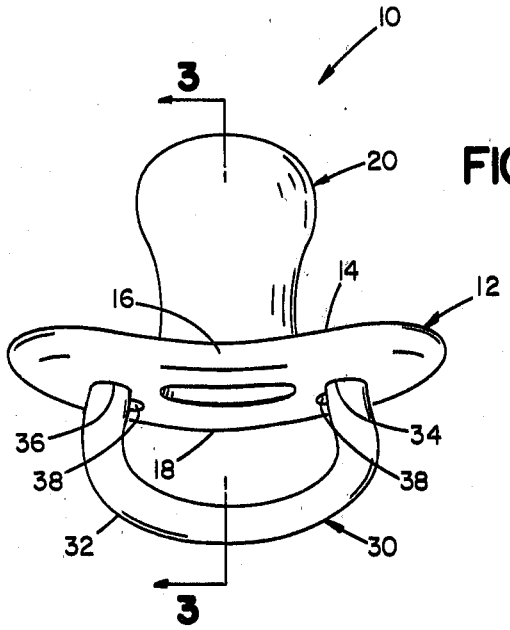
FIG. 2 is a top view of the pacifier taken along lines 2—2 of FIG. 1.

Handle 30 extends from the side of the shield 12 opposite the nipple 20. As best shown in FIG. 2, the handle 30 is composed of a solid cord 32 attached to the shield at connection points 34, 36. The connection points 34, 36 are at the approximate level as the nipple 20, as shown in FIGS. 1 and 3. Handle 30 extends downwardly from the shield 12 at an angle of approximately 45°. Breather holes 38 extend through the shield 12. Holes 38 are molded in the shield 12 so that the surface of the shield is smooth.

OPERATION

Figure 3:
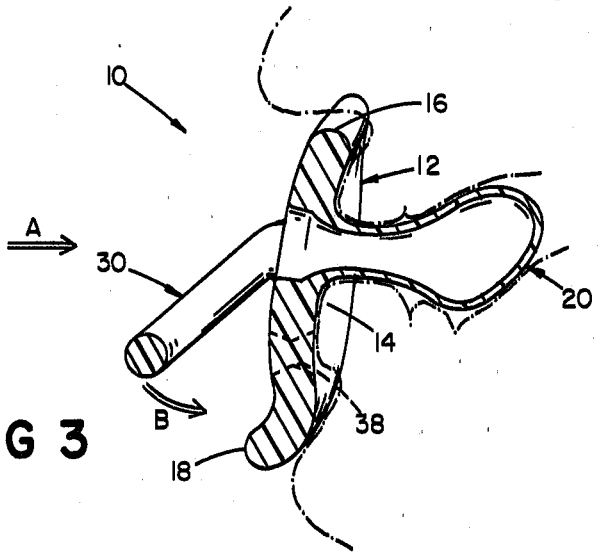
FIG. 3 is a view taken along lines 3—3 of FIG. 2 of the pacifier in use.

When the pacifier 20 is in use, as shown in FIG. 3, the nipple 20 rests in the infant's mouth. The concave, nipple side of the shield 12 is adjacent to the face area around the mouth. The lower portion 18 which includes the lower sides of the shield 12 however, curves away from the baby's face and chin. Therefore, this part of the shield is somewhat spaced away from the face, and it presents a broad area of the shield 12 for contact with the face and chin. This effectively prevents irritation which would result from a small area of a shield being in contact and pressed against a small area of the face and chin. The shape of the nipple 20 is well known and with such a shape, the infant will almost always position the pacifier 10 in the proper orientation, as shown in FIG. 3.

The handle 30 is flexible, and because of its angle, any force, e.g., the force resulting from an infant rolling onto its face, on the handle in the direction shown by arrow A in FIG. 3 only deflects the handle toward the shield 12, as shown by arrow B, and the relative position of the nipple 20 in the mouth stays the same. Should the pacifier become lodged in the infant's mouth, the breather holes 38 permit air to pass therethrough.

Other variations will occur to those skilled in the art.

What is claimed is:

1. A pacifier for an infant comprising:

a generally circular shield having an edge which is rounded and smooth, said edge having a top which is disposed near the infant's nose when said pacifier is in place and a bottom which is disposed opposite said top, said shield having a front side and a rear side, said front side being disposed adjacent to the infant's face when said pacifier is in place, said shield having a nipple attached to and extending from said front side, said shield having a substantially concave cross-section on said front side towards the infant's face from said top above said nipple when said pacifier is in place to the approximate midpoint between said nipple and said bottom, and a substantially convex cross-section on said front side towards the infant's face from the approximate midpoint between said nipple and said bottom to said bottom below said nipple, and a handle means attached to and extending from said rear side of said shield.

2. The pacifier of claim 1 wherein said handle means is at a fixed angle other than perpendicular to said shield, and said handle means is flexible so that pressure towards said shield temporarily collapses said handle towards said shield.

3. The pacifier of claim 2 wherein said shield, said nipple and said handle are unitary.

* * * * *